US005481998A

United States Patent [19]

Trent

[11] Patent Number: 5,481,998

[45] Date of Patent: Jan. 9, 1996

[54] RECREATIONAL BOAT CONSTRUCTION

[75] Inventor: Gary D. Trent, Redmond, Oreg.

[73] Assignee: Outboard Marine Corporation, Waukegan, Ill.

[21] Appl. No.: 64,194

[22] Filed: May 19, 1993

[51] Int. Cl.[6] ..... B63B 3/00

[52] U.S. Cl. ..... 114/355; 114/363

[58] Field of Search ..... 114/343, 355–359, 114/362, 363, 56

[56] References Cited

U.S. PATENT DOCUMENTS

| | | | |
|---|---|---|---|
| D. 190,400 | 5/1961 | Tritt | D71/1 |
| D. 276,147 | 10/1984 | Arima | D12/314 |
| D. 284,566 | 7/1986 | Hegg et al. | D12/313 |
| 2,376,753 | 5/1945 | Bowen | 114/357 |
| 3,848,284 | 11/1974 | Livingston | 114/357 |
| 4,821,667 | 4/1989 | Hargett, Sr. | 114/357 |
| 5,078,072 | 1/1992 | Horiuchi et al. . | |

FOREIGN PATENT DOCUMENTS

| | | | |
|---|---|---|---|
| 1187283 | 3/1959 | France | 114/357 |

*Primary Examiner*—Jesus D. Sotelo
*Attorney, Agent, or Firm*—Michael, Best & Friedrich

[57] ABSTRACT

The invention provides a fiberglass recreational boat comprising a hull piece having a cockpit with a floor, a deck piece having an integral aft seat with the aft seat being arcuately shaped, and a gunwale. The hull piece and the deck piece are mated at the gunwale with the aft seat being suspended above the cockpit floor.

20 Claims, 2 Drawing Sheets

RECREATIONAL BOAT CONSTRUCTION

BACKGROUND OF THE INVENTION

This invention relates to small fiberglass recreational boats, especially those commonly known as runabouts. These boats are generally made of a molded fiberglass hull piece and a molded fiberglass deck piece which are mated at the gunwale. The boats are generally reinforced by attaching longitudinal stringers and transverse bulk heads to the inside of the hull piece. A cockpit floor is then placed upon the stringers and bulkheads.

In some prior art boats the deck piece may also include a small aft deck and a motor well for an outboard motor. After the deck piece was mated to the hull piece, an aft seat was generally constructed in front of the aft deck, and this aft seat was supported by the cockpit floor.

In other types of boats, the deck piece may incorporate an entire cockpit, including a floor and inside walls. Accordingly, the cockpit floor may be attached to a rear deck by a rear inside wall which may also incorporate a seat.

Examples of the prior art boat construction include the following:

| | | |
|---|---|---|
| Des. 190,400 | 5/23/61 | Tritt |
| Des 276,147 | 10/30/84 | Arima |
| Des. 284,566 | 7/8/86 | Hegg, et al. |
| 1993 Chris-Craft catalogue, especially pages 4–7. | | |

SUMMARY OF THE INVENTION

The invention provides a fiberglass recreational boat comprising a hull piece having a port side wall having a top edge, a starboard side wall having a top edge, a bottom wall, with said bottom wall having an outer running surface and an inner surface, and a cockpit floor, with the cockpit floor supported on the bottom wall inner surface and having a top surface. The boat also comprises a deck piece having an outer edge with the outer edge mated to the hull port and starboard side wall top edges. The deck piece also has a port inner wall, a starboard inner wall and an aft seat joined to the port deck inner wall and the starboard deck inner wall and suspended above the cockpit floor upper surface.

In one embodiment, the aft seat has an arcuate shape between the port inner wall and the starboard inner wall.

In one embodiment, the aft seat comprises a substantially vertical back wall and a substantially horizontal lower ledge.

In one embodiment, the deck port inner wall has an aft end and the deck starboard inner wall has an aft end and the aft seat back wall has a port side outer edge and a starboard side outer edge and the port inner wall aft end joins with the seat back port outer edge and the starboard inner wall aft end joins with the seat back starboard outer edge.

In one embodiment the aft seat also has a short vertical wall depending from the forward end of the lower ledge. This short vertical wall may also join with the port and starboard deck inner walls at its outer ends.

In one embodiment, the deck piece also comprises raised horizontal deck portions behind the aft seat on the port and starboard sides. The boat may also comprise an outboard motor well centrally located behind the aft seat. In addition, a swim platform may be positioned behind the back seat, and a central diagonal deck portion may also be located behind the back seat.

The invention also provides a fiberglass recreational boat comprising a hull piece having a port side wall with a top edge, a starboard side wall with a top edge, and an aft wall having a top edge. The boat also has a deck piece having a port outer side wall having a bottom edge, a starboard outer side wall having a bottom edge and an aft end, the aft end having an outer wall and an integral inner aft seat, the aft end outer wall having a bottom edge and port and starboard raised horizontal decks. The aft seat has a substantially vertical back and a substantially horizontal lower ledge. The deck piece and the hull piece are mated at the hull wall top edges and the deck piece wall bottom edges.

In one embodiment, the boat deck piece also comprises a port inner wall and a starboard inner wall and the aft seat has a port edge and a starboard edge and the aft seat port edge mates with the port inner wall and the aft seat starboard edge mates with the starboard inner wall.

In one embodiment the aft seat also comprises a central portion and the aft seat is curved with a central portion rearward of the port and starboard edges.

In one embodiment, the boat comprises a cockpit floor having an upper surface and the aft seat is suspended above the cockpit floor.

The invention also provides a fiberglass recreational boat comprising a hull piece having a cockpit with a floor, a deck piece having an integral aft seat, with the aft seat being arcuately shaped, and a gunwale. The hull piece and the deck piece are mated at the gunwale with the aft seat being suspended above the cockpit floor.

A principle feature of the invention is the provision of an aft cockpit seat that is integral with the deck piece and which is suspended above the cockpit floor.

Another principle feature of the invention is the creation of a structurally strong deck piece by the inclusion of an aft seat into the deck piece along with other flat wall sections at various angles.

Another principle feature of the invention is the provision of an aft seat that is arcuately shaped and distinctive in appearance.

Other features and advantages of the invention will become apparent to those skilled in the art upon review of the following detailed description, claims, and drawings.

Figure 1:
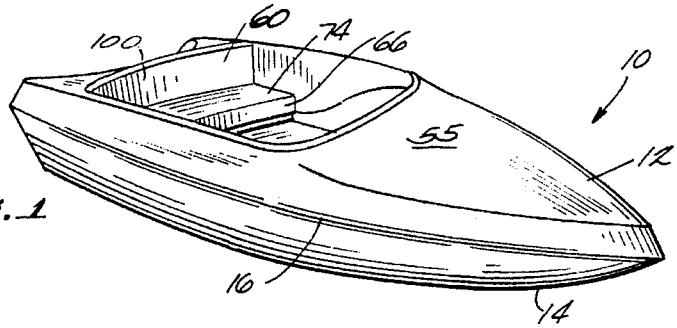
FIG. 1 is a front top perspective view of a boat embodying the invention.
Figure 2:
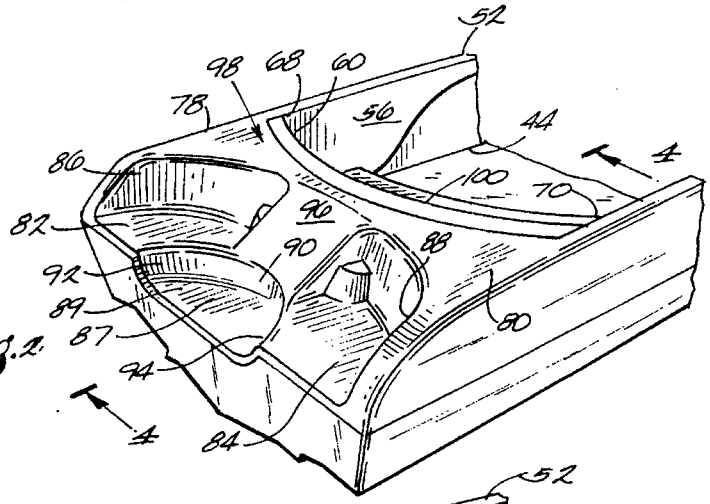
FIG. 2 is a rear top perspective view of the aft end of a boat embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a boat 10 embodying the invention. In the embodiment shown, the boat is approximately 17½' long and is generally of the outboard runabout type.

Figure 3:
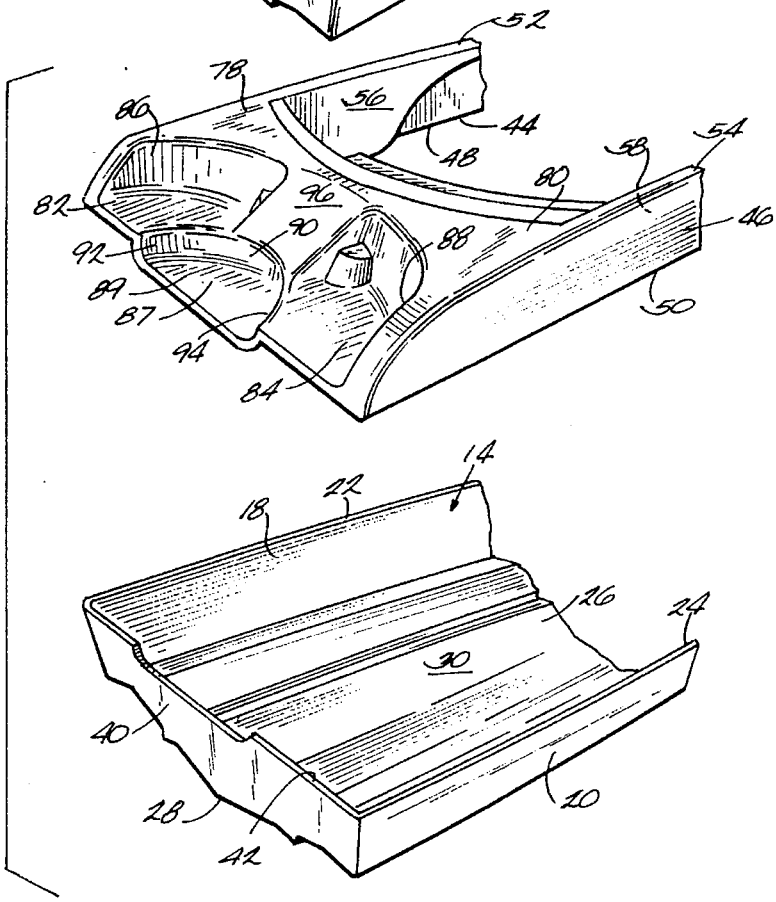
FIG. 3 is a rear perspective view of a hull piece and a mold piece before they are mated during construction of the boat seen in FIG. 2.
Figure 4:
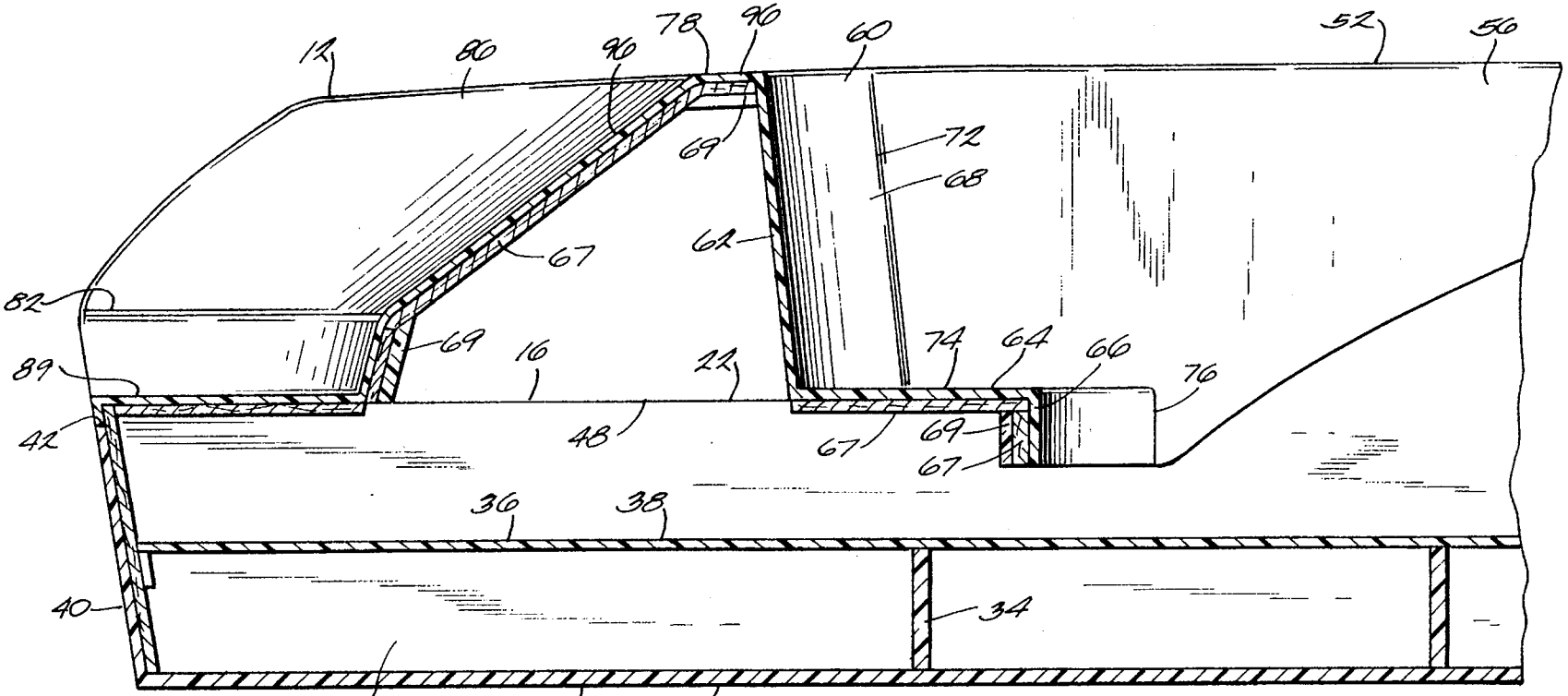
FIG. 4 is a sectional view of FIG. 2 taken along line 4—4.

As can be seen best in FIGS. 1 and 3, the boat 10 is generally constructed of a deck piece 12 and a hull piece 14. The boat is assembled by mating the deck piece 12 and the hull piece 14 along a gunwale 16. In a preferred embodiment, the pieces are mated and held together by a series of bolts spaced along the gunwale, and the bolts are ultimately hidden by a rub rail (not shown).

The hull piece 14, as seen best in FIG. 3, comprises a port side wall 18 and a starboard side wall 20 which meet at the bow. The port side wall 18 has a top edge 22 and the starboard side wall 20 has a top edge 24. Below and between the side walls is a hull bottom 26. In the embodiment shown in the drawings, the hull bottom has a V-shape in cross section as is common in outboard runabouts of this type. However, the invention may also work equally well with other hull bottom shapes, and is not limited to boats of a V-shaped hull bottom.

The outer surface of the hull bottom 26 comprises a running surface 28, and the inside surface 30 of the hull bottom supports a series of vertically standing longitudinal stringers 32 and transverse bulkheads 34. The stringers 32 and bulkheads 34 are incorporated into the hull piece 14 in order to give the boat structural rigidity. The hull stringers 32 and bulkheads 34 are made of a suitably rigid material such as fiberglass, or plywood or lumber and may preferably be attached to the hull bottom by being encapsulated by additional fiberglass and resin resulting in a strong bond to the inside surface 30 of the hull bottom 26.

Sitting atop the stringers 32 and bulk heads 34 through a major portion of the boat is a cockpit floor 36. In one embodiment, the floor is made of plywood sheets. The cockpit floor has an upper surface 38 upon which a suitable material such as carpeting may be placed.

The hull piece also comprises an aft transom 40. The transom is substantially vertical and has a top edge 42. In various embodiments, the transom has plywood reinforcement on its interior side or sandwiched between fiberglass layers.

The boat also comprises a deck piece 12 having a port outer side 44 and a starboard outer side 46. Each of the outer sides 44 and 46 extend upwardly from a port bottom edge 48 and a starboard bottom edge 50 to a port side horizonal surface 52 and a starboard side horizontal surface 54. In the embodiment shown, the port outer side 44 and starboard outer side 46 are substantially vertical in the aft portion of the boat, and in the forward portion of the boat the outer side walls blend to form a front deck 55. At the rear end of the front deck is preferably a windshield (not shown) behind which can be a helm station to control the boat.

Depending from the inboard edge of the port horizontal surface 52 in the central portion of the boat is a port inner side wall 56. In a similar manner, depending from the inboard edge of the starboard horizontal surface 54 is a starboard inner side wall 58. As can be seen in the figures, the inner side walls 56 and 58 are relatively short in the fore part of the central portion of the boat and become deeper near the aft end of the boat.

The deck piece 12 also comprises an aft end 98 having an integral aft seat 60. In a preferred embodiment, the aft seat comprises a seat back 62 and a lower seat ledge 64 with the seat back 62 being substantially vertical and the lower seat ledge 64 substantially horizontal. Depending from the front of the lower seat ledge 64 is a short lip 66. Reinforcing the fiberglass outer layer of the lower seat ledge 64 and the short depending lip 66 is preferably plywood or balsa wood 67 attached to the under side thereof. An additional inner layer of fiberglass may also be included for additional reinforcement 69 in selected areas.

The area behind the front deck 55, inboard of the port inner side wall 56 and starboard inner side wall 58 and in front of or below the aft seat 60 is the cockpit area of the boat.

The aft seat 60 also comprises a port edge 68 and a starboard edge 70. The port edge 68 comprises a port edge 72 of the seat back 62, a port edge 74 of the lower seat ledge 64 and a port edge 76 of the depending lip 66. Not shown are starboard edges of the seat back, lower ledge and lip, however, it can be appreciated that they are similar to the port edges.

The port edge 68 joins or mates with the port inner side wall 56. In similar manner, the starboard edge 70 joins or mates with the starboard inner side wall 58. Accordingly, the port 56 and starboard 58 inner side walls fully support the aft seat 60 which is suspended above the cockpit floor 36. As seen in the figures, the deck piece 12 is supported around its port bottom edge 48 and starboard bottom edge 50 by the port hull side wall top edge 22 and starboard hull top edge 24. The aft seat 60 is integral with the hull piece and is suspended above the cockpit floor 36 top surface 38.

As can be seen, in a preferred embodiment the aft seat 60 has an arcuate shape with the central portion 100 of the aft seat rearward of the port 68 and starboard 70 edges of the aft seat 60.

As can be appreciated in the figures, the boat construction is aesthetically pleasing, especially with the curved aft seat as shown in the figures. The arcuate shape also aids in increasing the structural rigidity of the deck piece 12 and accordingly the overall strength of the boat 10.

The deck piece 12 also comprises a port raised horizontal deck 78 immediately behind the aft seat 60 on the port side of the boat and a starboard raised horizontal deck 80 immediately behind the aft seat on the starboard side of the boat. In a preferred embodiment, each of the port and starboard raised horizontal decks 78 and 80 has three sides, with the sides having a curvilinear shape, as shown in the figures.

Behind the port 78 and starboard horizontal decks are port 82 and starboard 84 swim platforms. Each of the swim platforms has a horizontal upper surface which terminates at a forward vertical wall 86 on the port side and 88 on the starboard side. The aft ends of the port 82 and starboard 84 swim platforms mate with the transom top edge 42 to comprise the aft extreme end of the boat.

Between the port 82 and starboard 84 swim platforms is an outboard motor well 87, upon whose aft wall, or the transom wall 40, an outboard motor (not shown) can be mounted for propelling the boat 10 through the water. The outboard motor well also comprises a bottom 89, a front wall 90 and a port 92 and starboard side wall 94.

Also between the port 82 and starboard 84 swim platforms and in front of the motor well 86 is a central diagonal wall 96 which also may be reinforced on its underside by plywood.

The integration of the aft 60 seat with the swim platforms 82 and 84, vertical walls 86 and 88, horizontal decks 78 and 80 and diagonal wall 96 of the aft end 98 create a deck piece that has enhanced structural rigidity especially in its aft end. The deck piece is especially strong with respect to bending and torsional forces, which are the forces it is typically subjected to when the outboard motor drives the boat through the water. Accordingly, fewer stringers 32 and bulkheads 34 may be needed in order to produce a strong boat. In addition, the thickness of fiberglass in the walls of the hull and deck pieces may be reduced and a strong boat can still be produced.

The integration of the aft seat in the deck piece as shown and described herein also can act as a means to save labor costs in building the boat, as the aft seat can be easily constructed out of fiberglass and resin concurrently with the hull piece. Previously the aft seat was built up from plywood members on top of the cockpit floor as a separate operation.

Various features of the invention are set forth in the following claims.

I claim:

1. A fiberglass recreational boat comprising a hull piece having a port side wall having a top edge, a starboard side wall having top edge, a bottom wall having an outer running surface and an inner surface, and a cockpit floor spaced above said bottom wall inner surface and having a top surface, and a deck piece having an outer edge supportingly engaged by said hull piece, port and starboard side wall top edges, a port inner wall joined to said port side wall top edge, a starboard inner wall joined to said starboard side wall top edge, an arcuate seat joined to said port deck inner wall and said starboard deck inner wall, supported above said cockpit floor top surface solely by said engagement of said outer edge of said deck piece with said port and starboard side wall top edges of said hull piece, and including a substantially vertical back wall and a substantially horizontal lower ledge, a port raised horizontal portion behind said seat, a starboard raised horizontal portion behind said seat, an outboard motor well behind said seat, a port aft swim platform aft of said seat and beside said motor well, and a starboard aft swim platform aft of said seat and beside said motor well.

2. The boat of claim 1 wherein said deck piece also includes a central diagonal deck portion aft of said seat and forward of said motor well.

3. A fiberglass recreational boat comprising a hull piece having a port side wall with a top edge, and a starboard side wall with a top edge, and a one-piece deck having a port outer side wall having a bottom edge supportingly engaged with said top edge of said port side wall of said hull piece, a starboard outer side wall having a bottom edge supportingly engaged with said top edge of said starboard side wall of said hull piece, a port raised horizontal deck, a starboard raised horizontal deck, an integral seat supported in spaced relation from said hull piece solely the engagement of said port and starboard bottom edges of said deck on said top edges of said port and starboard side walls of said hull piece and including a substantially vertical seat back portion, a substantially horizontal lower seat ledge and, a short depending front lip, and a lower horizontal swim platform.

4. The boat of claim 3 wherein said deck piece has a centerline, and wherein said swim platform has an aft edge transverse to said centerline of the boat.

5. The boat of claim 3 wherein said deck piece also includes an aft outer wall and wherein said aft outer wall also comprises an outboard motor well.

6. The boat of claim 5 wherein said outboard motor well has a substantially horizontal bottom wall and forward, port and starboard vertical walls.

7. A fiberglass recreational boat comprising a hull piece having a cockpit with a floor, and a deck piece solely supported by said hull piece at a gunwale and including a seat suspended above said cockpit floor and being otherwise free of support from said hull piece, an outboard motor well behind said seat, a port aft swim platform aft of said seat and beside said motor well, and a starboard aft swim platform aft of said seat and beside said motor well.

8. The boat of claim 7 wherein said seat comprises a substantially vertical back wall and a substantially horizontal lower ledge.

9. The boat of claim 8 wherein said deck piece also comprises an aft port raised horizontal portion behind said seat and an aft starboard raised horizontal portion behind said seat.

10. The boat of claim 9 wherein said deck piece also includes a central diagonal deck portion aft of said seat and forward of said motor well.

11. The boat of claim 8 wherein said seat back wall and said seat ledge are arcuately shaped.

12. A fiberglass recreational boat comprising a hull piece having a port side wall having a top edge, a starboard side wall having a top edge, and a deck piece having an outer edge supportingly engaged by said hull piece port and starboard side wall top edges, a seat joined to said outer edge, a port raised horizontal portion behind said seat, a starboard raised horizontal portion behind said seat, an outboard motor well behind said seat, a port aft swim platform aft of said seat and beside said motor well, and a starboard aft swim platform aft of said seat and beside said motor well.

13. A boat in accordance with claim 12 wherein said deck piece also includes port and starboard side wall top edges extending from said outer edge, a port inner wall joined to said port side wall top edge, and a starboard inner wall joined to said starboard side wall top edge.

14. The boat of claim 13 wherein said seat has an arcuate shape between said port inner wall and said starboard inner wall.

15. The boat of claim 14 wherein said seat comprises a substantially vertical back wall and a substantially horizontal lower ledge.

16. The boat of claim 15 wherein said deck port inner wall has an aft end and said deck starboard inner wall has an aft end and said aft seat back wall has a port side outer edge and a starboard side outer edge and said port inner wall aft end joins with said seat back port outer edge and said starboard inner wall aft end joins with said seat back starboard outer edge.

17. The boat of claim 15 wherein said seat lower ledge also comprises a forward end, and a short vertical wall depending from said forward end.

18. The boat of claim 17 wherein said short vertical wall has a port end and a starboard end and said port end joins with said deck port inner wall and said starboard end joins with said starboard inner wall.

19. The boat of claim 15 wherein said deck piece also comprises a port raised horizontal portion behind said seat and a starboard horizontal portion behind said seat.

20. The boat of claim 19 wherein said deck piece also includes an outboard motor well behind said aft seat.

* * * * *